US012601256B1

(12) United States Patent
Shu

(10) Patent No.: US 12,601,256 B1
(45) Date of Patent: Apr. 14, 2026

(54) IN-SITU STRESS MEASUREMENT METHOD BASED ON INDENTATION TECHNOLOGY AND MACHINE LEARNING

(71) Applicant: Institute of Geomechanics, Chinese Academy of Geological Sciences, Beijing (CN)

(72) Inventor: Siqi Shu, Beijing (CN)

(73) Assignee: Institute of Geomechanics, Chinese Academy of Geological Sciences, Beijing (CN)

( * ) Notice: Subject to any disclaimer, the term of this patent is extended or adjusted under 35 U.S.C. 154(b) by 0 days.

(21) Appl. No.: 19/004,483

(22) Filed: Dec. 30, 2024

(30) Foreign Application Priority Data

Oct. 11, 2024 (CN) ..... 202411415060.X

(51) Int. Cl.
*E21B 49/00* (2006.01)
*E21B 47/002* (2012.01)

(52) U.S. Cl.
CPC ..... *E21B 49/006* (2013.01); *E21B 47/0025* (2020.05); *E21B 2200/22* (2020.05)

(58) Field of Classification Search
CPC . E21B 49/006; E21B 47/0025; E21B 2200/22
See application file for complete search history.

(56) References Cited

U.S. PATENT DOCUMENTS 5,511,615 A * 4/1996 Rhett ..... E21B 49/006 166/308.1
12,025,589 B2 * 7/2024 Han ..... G01N 3/08
12,085,540 B1 * 9/2024 Zhang ..... G01N 23/046
2022/0207218 A1 6/2022 Lu et al.
2022/0291419 A1 * 9/2022 Bathija ..... E21B 44/00
2024/0280451 A1 * 8/2024 Wang ..... G01N 1/44
2025/0290842 A1 * 9/2025 Liu ..... G01N 33/24

FOREIGN PATENT DOCUMENTS

CN 111257536 A 6/2020

* cited by examiner

*Primary Examiner* — Eric S. McCall

(57) ABSTRACT

An in-situ stress measurement method based on indentation technology and machine learning includes steps as follows. A rock core is obtained to be processed into a sample. A shallow indentation test is conduct on the sample to obtain the indentation load-depth curve and the equivalent elastic model is derived. A deep indentation test is performed and the test data is used as actual training samples for machine learning. The actual training sample set is input into the neural network for network training to obtain an inverse problem model of in-situ stress. An in-situ indentation test is performed on the sample and, based on the equivalent elastic model, the minimum and maximum horizontal principal stresses are calculated. A direction of main crack of an indentation at a bottom of a borehole as a direction of the maximum horizontal principal stress is measured by an imaging logging tool.

6 Claims, 2 Drawing Sheets

IN-SITU STRESS MEASUREMENT METHOD BASED ON INDENTATION TECHNOLOGY AND MACHINE LEARNING

TECHNICAL FIELD

The disclosure relates to the field of in-situ stress measurement, and particularly to an in-situ stress measurement method based on indentation technology and machine learning.

BACKGROUND

As the demand for energy and mineral resources increases and the intensity of mining continues to grow, shallow mineral resources are becoming increasingly scarce. In deep mines, a proportion of tunnels with broken and soft surrounding rocks in high in-situ stress (also referred to as geostress) conditions has increased dramatically. Disasters caused by soft rock large deformation occur frequently, typically characterized by high stress, large deformation, strong rheology, low strength, and difficulty in support, which have become a focus and challenge of rock mechanics research in deep mining.

The commonly used methods for measuring in-situ stress often simplify rock masses into mechanical models such as elastic, viscoelastic, and poroelastic or ideal elastoplastic models, leading to the fact that various common in-situ stress testing methods have their scope of application and certain limitations.

A hydraulic fracturing method is based on linear elastic mechanics and proposes assumptions as follows: a rock mass at a measurement point is a continuous, uniform, and isotropic linear elastic body, and the rock mass at the measurement point is impermeable. A borehole must be parallel to one of principal stresses of the rock mass. Although the method can measure a minimum horizontal principal stress well, it has a large error in measuring a maximum horizontal principal stress and cannot be used to measure in-situ stress values in rock broken zones or plastic deformation zones. An in-situ stress relief method assumes that a rock mass is a continuous, homogeneous, and isotropic linear clastic body, and that a stress experienced by the rock mass during loading and unloading has a same functional relationship as that of the rock mass undergoes strain. The in-situ stress relief method uses solutions of an elastic theory to calculate magnitudes and directions of in-situ stress on rock mass units. The method has high requirements to rock masses to-be-measured and is difficult to be used for deep in-situ stress measurements. An anelastic strain recovery method assumes that a rock is a homogeneous, isotropic viscoelastic material, and when a rock core is separated from a surrounding rock mass, some part of the rock undergoes immediate elastic recovery, while rest part of the rock undergoes slow anelastic recovery over time, and a strain recovery in all directions is positively correlated with a pressure previously suffered. For rocks with high argillaceous mineral content (such as shale), a contraction deformation caused by mineral dehydration during measurement is opposite to expansion deformation caused by stress release, so an anelastic strain recovery method is not suitable for the rock samples with the high argillaceous mineral content. Borehole breakout method uses a shape of a borehole wall collapse and rock strength parameters to determine a magnitude of a horizontal principal stress, and estimates a stress value based on a depth and a width of the wall collapse. If there is no collapse in the borehole, relevant in-situ stress information cannot be obtained, and if the rock is anisotropic or heterogeneous, which will also bring a large error to determination of in-situ stress values and directions. Acoustic emission method is based on an elastic theory and uses the Kaiser effect of rock acoustic emission to measure in-situ stress. However, since the acoustic emission is related to a propagation of elastic waves, high-strength brittle rocks usually have a more obvious Kaiser effect, while porous low-strength and plastic rock masses often have an inconspicuous Kaiser effect. Therefore, it is generally not recommended to use the acoustic emission method to measure stress in soft and loose plastic rock masses, and it is only allowed to be used within the elastic range of the rock (within 60% of the rock's strength limit). Focal mechanism of earthquake is based on a linear elastic theory, using a discrete focal mechanism of each microseismic event and the faulting direction of the rupture plane as input parameters, and performs in-situ stress inversion based on an actual fault plane sliding vector, which can obtain statistically significant in-situ stress. The method can only determine stress changes caused by earthquakes in a seismic source area, a spatial structural stress direction of a large area, and relative magnitudes of three principal stresses, but not absolute values. Since each in-situ stress measurement method has its limitations, in recent years, multiple methods are often used in combination to measure the in-situ stress of a region, and in-situ measurement, numerical simulation, and mechanical modeling methods have been developed to adapt to various complex geological conditions and improve data accuracy.

Deep Earth rocks and shallow soft rocks often exhibit significant nonlinear characteristics. However, current in-situ stress testing technologies based on the elastic theory find it difficult to accurately measure the in-situ stress in deep soft rock areas. There is an urgent need to study a nonlinear stress-strain relationship of rocks under high temperature and high confining pressure, and to establish in-situ stress measurement methods suitable for deep and shallow soft rocks based on this understanding. This will provide scientific and technological support for deep Earth exploration and underground engineering construction.

SUMMARY

To solve the above technical problems, the disclosure provides an in-situ stress measurement method based on indentation technology and machine learning to solve the problems in the related art. The technical solutions adopted by the disclosure are as follows.

An in-situ stress measurement method based on indentation technology and machine learning includes steps as follow.

- Step 1: a rock core is drilled and taken from a rock, an original temperature of the rock core is recorded, and the rock core is moisture-preserved and stored.
- Step 2: the rock core is processed into a rock core sample.
- Step 3: a pressure of an overlying rock layer of the rock core sample is calculated.
- Step 4: the rock core sample is heated to the original temperature of the rock core, a shallow indentation test is conducted on the rock core sample using a conical indenter to obtain an indentation load-depth curve, and an equivalent elastic model of rock core is derived.
- Step 5: the rock core sample is heated to the original temperature of the rock core, minimum horizontal principal stresses and maximum horizontal principal stresses are set, a deep indentation test is conducted on the rock core sample using the conical indenter to obtain test data, and the test data is used as an actual training sample for machine learning.

Step 6: a training set of a neural network is constructed based on the test data, and the training set is input into the neural network for network training to obtain an inverse problem model of in-situ stress.

Step 7: an in-situ indentation test is performed on the rock core sample to obtain an in-situ indentation load-depth curve, a curvature of loading curve, a slope at a maximum indentation depth of unloading curve, and a ratio of residual work to total work of the in-situ indentation load-depth curve are calculated. The curvature of loading curve, the slope at the maximum indentation depth of unloading curve, and the ratio of residual work to total work are input into the neural network after being trained to obtain output values being a dimensionless value of maximum horizontal principal stress and a dimensionless value of minimum horizontal principal stress, and then a minimum horizontal principal stress and a maximum horizontal principal stress are calculated based on the equivalent elastic model of rock core derived in the step 4.

Step 8: a direction of main crack of an indentation at a bottom of a borehole as a direction of the maximum horizontal principal stress is measured by an imaging logging tool.

The beneficial effects of the disclosure are as follows.

This disclosure provides an in-situ stress measurement method based on indentation technology and machine learning. Compared to current conventional rock mechanics performance measurement techniques, the indentation technology is convenient to operate and can perform in-situ testing on the mechanical behavior of deep Earth rocks. The deep Earth rocks exhibit ductile deformation characteristics, and the Bayesian neural network used can construct nonlinear mechanical models, which can not only depict the elastic deformation behavior of the deep Earth rocks but also their plastic deformation, overcoming the shortcomings of current in-situ stress measurement methods based on elastic theory and further expanding the range of in-situ stress measurement in the deep Earth rocks.

DETAILED DESCRIPTION OF EMBODIMENTS

Figure 1:
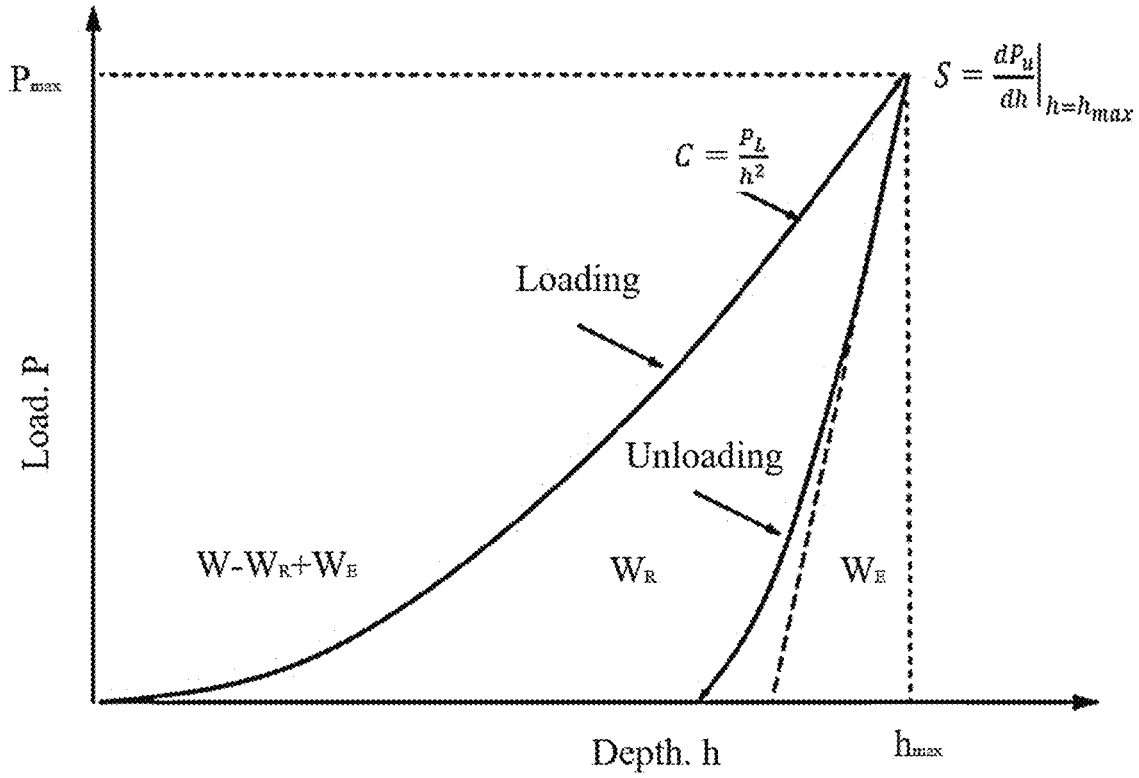
FIG. 1 illustrates a schematic diagram of an indentation load-depth curve according to an embodiment of the disclosure.
Figure 2:
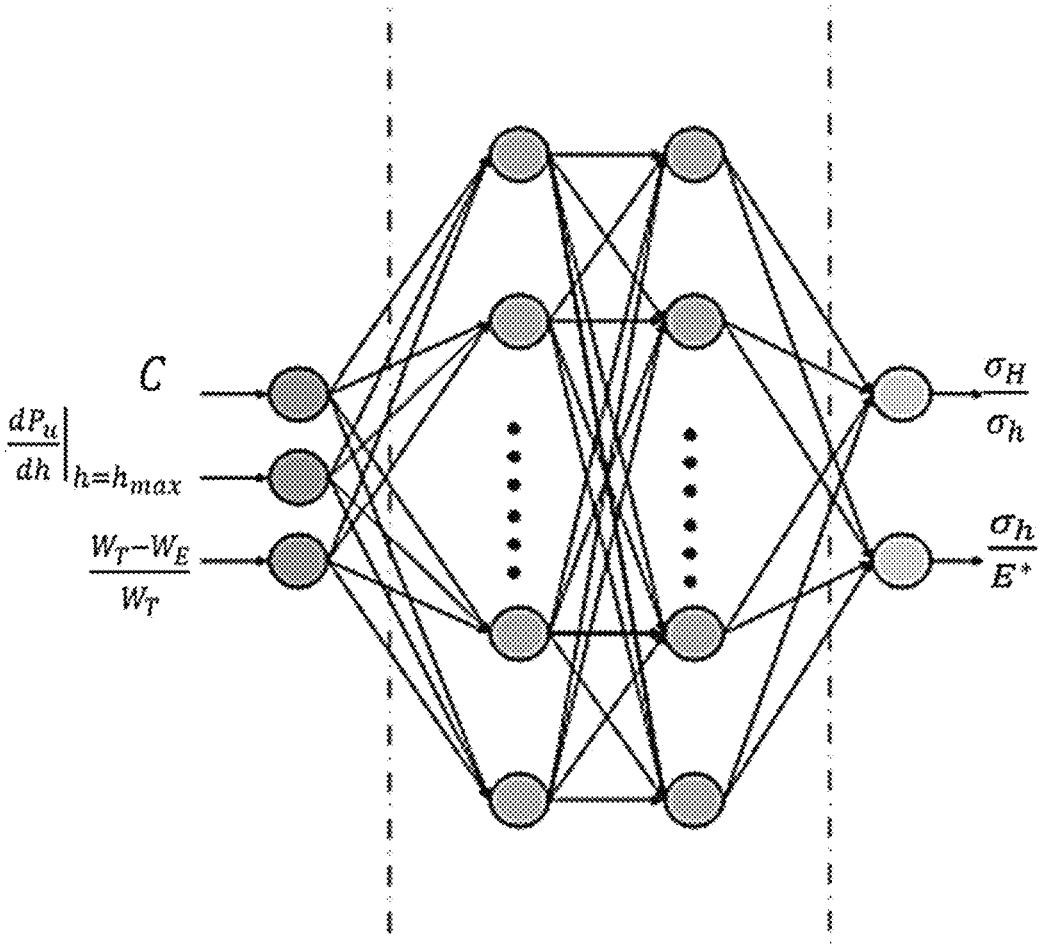
FIG. 2 illustrates a schematic diagram of an inverse problem model of in-situ stress based on a Bayesian neural network according to an embodiment of the disclosure.

The following will combine FIGS. 1-2 from the embodiment of the disclosure to provide a clear and complete description of the technical solution in the embodiment of the disclosure. Apparently, the described embodiment is only a part of the embodiments of the disclosure, not all embodiments. Unless specifically indicated, the technical means used in the embodiment are conventional means known to those skilled in the art.

An in-situ stress measurement method based on indentation technology and machine learning includes steps as follows.

Step 1: a rock core is drilled and taken from a rock, an original temperature of the rock core is recorded, and the rock core is moisture-preserved and stored.

Step 2: the rock core is processed into a rock core sample (with 5 cm×5 cm×10 cm).

Step 3: a pressure of an overlying rock layer of the rock core sample is calculated using a formular (1) expressed as follows:

$$p=\rho g h_r \tag{1}$$

where $\rho$ represents a density of rock, g represents a gravitational acceleration, and $h_r$ represents a thickness of the overlying rock layer.

Step 4: the rock core sample is heated to the original temperature of the rock core, a shallow indentation test (a ratio of an indentation depth h to an average scale L of microstructures of the rock core sample is greater than 5, and a ratio of the indentation depth h to a side length b of a cross-section of the rock core sample is less than 0.2) is conducted on the rock core sample using a conical indenter to obtain an indentation load-depth curve, and an equivalent elastic model of rock core is derived by using the formulars (2)-(6) expressed as follows:

$$E^* = \frac{\sqrt{\pi}}{2\beta}\frac{S}{\sqrt{A}} \tag{2}$$

$$E^* = \left[\frac{1-\upsilon^2}{E} + \frac{1-\upsilon_i^2}{E_i}\right]^{-1} \tag{3}$$

$$S = \left.\frac{dP_u}{dh}\right|_{h=h_{max}} \tag{4}$$

$$A = \frac{\pi}{3}h_c^2 \tag{5}$$

$$h_c = h_{max} - 0.72\frac{P_{max}}{S} \tag{6}$$

where E and v represent a Young's modulus and a Poisson's ratio of soft rock, respectively, and the soft rock refers to rocks that can undergo significant plastic deformation under specific environmental conditions of pressure and temperature; $E_i$ and $v_i$ represent a Young's modulus and a Poisson's ratio of an indenter, respectively; E* represents an equivalent Young's modulus; S represents a slope of unloading curve; $\beta$ represents a constant related to a geometrical shape of the indenter; $P_u$ represents a pressure during unloading the indenter; h represents an indentation depth; $h_{max}$ represents the maximum indentation depth; A represents a contact area of the indenter with the rock core sample; $h_c$ represents a contact depth of the indenter with the rock core sample.

Step 5: the rock core sample is heated to the original temperature of the rock core, minimum horizontal principal stresses are set as $\rho g h_r$, $1.2\rho g h_r$, $1.6\rho g h_r$, $2\rho g h_r$, $2.4\rho g h_r$, and maximum horizontal principal stresses are set as $0.8\rho g h_r$, $1.44\rho g h_r$, $2.56\rho g h_r$, $4\rho g h_r$, $5.76\rho g h_r$, a deep indentation test is conducted on the rock core sample using the conical indenter with a top angle of 60 degrees to obtain a series of indentation load-depth curves, a ratio of the indentation depth h to a side length b of a cross-section of the rock core sample is greater than 0.2 and less than 0.5. the curvature C of loading curve, the slope of at the maximum indentation depth $$\left.\frac{dP_u}{dh}\right|_{h=h_{max}}$$

of unloading curve, and the ratio of residual work to total work $$\frac{W_T - W_E}{W_T}$$

of each of the series of indentation load-depth curves of the rock core sample are calculated to take them as the actual training sample for machine learning, as shown in FIG. 1.

Specifically, the curvature C of loading curve, the slope $$\left.\frac{dP_u}{dh}\right|_{h=h_{max}}$$

at a maximum indentation depth of unloading curve, and the ratio of residual work to total work $$\frac{W_T - W_E}{W_T}$$

of each of the series of indentation load-depth curves of the rock core sample are related to mechanical parameters of the rock core expressed by formulas (7)-(9) as follows:

$$C = \frac{P}{h^2} = E^* \prod_1 \left(\frac{\sigma_Y}{E^*}, n, \frac{c_0}{E^*}, \varphi_0, \frac{\sigma_H}{\sigma_h}, \frac{\sigma_h}{E^*}, \frac{T}{T_0}\right) \tag{7}$$

$$\left.\frac{dP_u}{dh}\right|_{h=h_{max}} = E^* h_{max} \prod_2 \left(\frac{\sigma_Y}{E^*}, n, \frac{c_0}{E^*}, \varphi_0, \frac{\sigma_H}{\sigma_h}, \frac{\sigma_h}{E^*}, \frac{T}{T_0}\right) \tag{8}$$

$$\frac{W_T - W_E}{W_T} = E^* h_{max} \prod_3 \left(\frac{\sigma_Y}{E^*}, n, \frac{c_0}{E^*}, \varphi_0, \frac{\sigma_H}{\sigma_h}, \frac{\sigma_h}{E^*}, \frac{T}{T_0}\right) \tag{9}$$

where $$C, \left.\frac{dP_u}{dh}\right|_{h=h_{max}}, \text{ and } \frac{W_T - W_E}{W_T}$$

respectively represent the curvature of loading curve, the slope of at the maximum indentation depth of unloading curve, and the ratio of residual work to total work of each of the series of indentation load-depth curves; E* represents the equivalent Young's modulus; $h_{max}$ represents the maximum indentation depth; $\sigma_Y$ represents a yield strength of soft rock; n represents a stain-hardening exponent of soft rock; $c_0$ represents a cohesion of soft rock; $\varphi_0$ represents an internal friction angle of soft rock; $\sigma_H$ and $\sigma_h$ represent a maximum horizontal principal stress and a minimum horizontal principal stress, respectively; $T_0$ represents a normal temperature; T represents a real temperature.

Step 6: as shown in FIG. 2, the inverse problem model of in-situ stress is constructed based on a Bayesian neural network. A generative adversarial network is used to expand the actual training samples to obtain the training set. The training set is input into the neural network for network training, and a KL (abbreviation of Kullback-Leibler) divergence of a variational distribution of the Bayesian neural network and a KL divergence of a posterior distribution of the Bayesian neural network are minimized to learn network weights of the Bayesian neural network, thereby obtaining the inverse problem model of in-situ stress.

Step 7: an in-situ indentation test is performed on the rock core sample to obtain an in-situ indentation load-depth curve, a curvature of a loading curve Co, a slope at a maximum indentation depth of the unloading curve $$\left.\frac{dP_u}{dh}\right|_{h=h_{m0}},$$

and a ratio of residual work to total work of the in-situ indentation load-depth curve $$\frac{W_{T0} - W_{E0}}{W_{T0}}$$

are calculated. The curvature of the loading curve, the slope at the maximum indentation depth of the unloading curve, and the ratio of residual work to total work are input into the neural network after being trained to obtain output values being a dimensionless maximum horizontal principal stress $$\frac{\sigma_H}{\sigma_h}$$

and a dimensionless minimum horizontal principal stress $$\frac{\sigma_h}{E^*},$$

and then a minimum horizontal principal stress E* and a maximum horizontal principal stress $\sigma_h$ are calculated based on the equivalent elastic model of the rock core derived in the step 4.

step 8: a direction of main crack of an indentation at a bottom of a borehole (e.g., a drilling well, or a drilled well) as a direction of the maximum horizontal principal stress is measured by an imaging logging tool.

Borehole ultrasonic imaging is characterized by high resolution, high precision, and the ability to obtain clear images even in turbid well fluids, which can provide wealth of useful information needed for engineering basic analysis, thus the borehole ultrasonic imaging has been widely applied. For example, a high-resolution acoustic televiewer (HIRAT) from RobertsonGeologging in the UK. A high-resolution acoustic television is a device designed to provide qualitative images of borehole walls. Because the high-resolution acoustic television uses ultrasound instead of visible light, it can work in turbid well water, expanding its range of application. In addition, due to its high-resolution and accurate determination of direction, it is particularly suitable for determining detailed conditions of rock layer fracture orientation, dip, and development of fractures, analyzing geological structures, and providing reliable basis for geological, hydrogeological research, or major engineering evaluations. A main part of a logging system is shown in FIG. 1. Micrologger2 is the most powerful portable logging system on the market today, equipped with a USB interface for connection with a notebook, dual digital signal processing (DSP) processors, and a built-in borehole video support module. The Micrologger2 is lightweight, smaller in size than a typical notebook, and powerful, supporting all RG probes and cameras, including the latest developed acoustic and optical imaging systems. The Micrologger2 only requires a PC, a probe, and a winch provided by RG or a third party to provide high-quality logging and drilling television data under any circumstances.

The above embodiment is only a description of a preferred embodiment of the disclosure and do not limit the scope of the disclosure. Without departing from the design spirit of the disclosure, various modifications, variations, and substitutions made by those skilled in the art to the technical solution of the disclosure should fall within the scope of protection determined by the claims of the disclosure.

What is claimed is:

1. An in-situ stress measurement method based on indentation technology and machine learning, comprising:

step 1: drilling and taking a rock core, recording an original temperature of the rock core, and moisture-preserving and storing the rock core;

step 2: processing the rock core into a rock core sample;

step 3: calculating a pressure of an overlying rock layer of the rock core sample;

step 4: heating the rock core sample to the original temperature of the rock core, conducting a shallow indentation test on the rock core sample using a conical indenter to obtain an indentation load-depth curve, and deriving an equivalent elastic model of rock core;

step 5: heating the rock core sample to the original temperature of the rock core, setting minimum horizontal principal stresses and maximum horizontal principal stresses, conducting a deep indentation test on the rock core sample using the conical indenter to obtain test data, and using the test data as an actual training sample for machine learning;

step 6: constructing a training set of a neural network based on the test data, and inputting the training set into the neural network for network training to obtain an inverse problem model of in-situ stress;

step 7: performing an in-situ indentation test on the rock core sample to obtain an in-situ indentation load-depth curve, calculating a curvature of loading curve, a slope at a maximum indentation depth of unloading curve, and a ratio of residual work to total work of the in-situ indentation load-depth curve; inputting the curvature of loading curve, the slope at the maximum indentation depth of unloading curve, and the ratio of residual work to total work into the neural network after being trained to obtain output values being a dimensionless value of maximum horizontal principal stress and a dimensionless value of minimum horizontal principal stress, and then calculating a minimum horizontal principal stress and a maximum horizontal principal stress based on the equivalent elastic model of rock core derived in the step 4; and step 8: measuring, by an imaging logging tool, a direction of main crack of an indentation at a bottom of a borehole as a direction of the maximum horizontal principal stress;

wherein the step 5 comprises:

obtaining a series of indentation load-depth curves through the deep indentation test;

calculating a curvature of loading curve, a slope at a maximum indentation depth of unloading curve, and a ratio of residual work to total work of each of the series of indentation load-depth curves, and taking the curvature of loading curve, the slope;

wherein the curvature of loading curve C, the slope $$\left.\frac{dP_u}{dh}\right|_{h=h_{max}}$$

of at the maximum indentation depth of unloading curve, and the ratio $$\frac{W_T - W_E}{W_T}$$

of residual work to total work of each of the series of indentation load-depth curves of the rock core sample are related to mechanical parameters of rock core expressed by formulas (7)-(9) as follows:

$$C = \frac{P}{h^2} = E^* \prod_1 \left(\frac{\sigma_Y}{E^*}, n, \frac{c_0}{E^*}, \varphi_0, \frac{\sigma_H}{\sigma_h}, \frac{\sigma_h}{E^*}, \frac{T}{T_0}\right) \tag{7}$$

$$\left.\frac{dP_u}{dh}\right|_{h=h_{max}} = E^* h_{max} \prod_2 \left(\frac{\sigma_Y}{E^*}, n, \frac{c_0}{E^*}, \varphi_0, \frac{\sigma_H}{\sigma_h}, \frac{\sigma_h}{E^*}, \frac{T}{T_0}\right) \tag{8}$$

$$\frac{W_T - W_E}{W_T} = E^* h_{max} \prod_3 \left(\frac{\sigma_Y}{E^*}, n, \frac{c_0}{E^*}, \varphi_0, \frac{\sigma_H}{\sigma_h}, \frac{\sigma_h}{E^*}, \frac{T}{T_0}\right) \tag{9}$$

where E* represents an equivalent Young's modulus.

2. The in-situ stress measurement method based on indentation technology and machine learning as claimed in claim 1, wherein the step 3 further comprises:

calculating the pressure of the overlying rock layer of the rock core according to a formula (1) expressed as follows:

$$p = \mu g h_r \tag{1}$$

where ρ represents a density of rock, g represents a gravitational acceleration, and $h_r$ represents a thickness of the overlying rock layer.

3. The in-situ stress measurement method based on indentation technology and machine learning as claimed in claim 1, wherein the deriving an equivalent elastic model of rock core in step 4 comprises formulas (2)-(6) expressed as follows:

$$E^* = \frac{\sqrt{\pi}}{2\beta} \frac{S}{\sqrt{A}} \tag{2}$$

$$E^* = \left[\frac{1-\upsilon^2}{E} + \frac{1-\upsilon_i^2}{E_i}\right]^{-1} \tag{3}$$

$$S = \left.\frac{dP_u}{dh}\right|_{h=h_{max}} \tag{4}$$

$$A = \frac{\pi}{3} h_c^2 \tag{5}$$

$$h_c = h_{max} - 0.72 \frac{P_{max}}{S} \tag{6}$$

where E and v represent a Young's modulus and a Poisson's ratio of soft rock, respectively; $E_i$ and $v_i$ represent a Young's modulus and a Poisson's ratio of an indenter, respectively; E* represents an equivalent Young's modulus; S represents a slope of unloading curve; β represents a constant related to a geometrical shape of the indenter; $P_u$ represents a pressure during unloading the indenter; h represents an indentation depth; $h_{max}$ represents the maximum indentation depth;

A represents a contact area of the indenter with the rock core sample; $h_c$ represents a contact depth of the indenter with the rock core sample.

4. The in-situ stress measurement method based on indentation technology and machine learning as claimed in claim 1, wherein the step 6 specifically comprises:

constructing the inverse problem model of in-situ stress based on a Bayesian neural network;

using a generative adversarial network to expand the actual training samples to obtain the training set;

inputting the training set into the neural network for network training;

learning network weights of the Bayesian neural network, by minimizing a Kullback-Leibler (KL) divergence of a variational distribution of the Bayesian neural network and a KL divergence of a posterior distribution of the Bayesian neural network, thereby obtaining the inverse problem model of in-situ stress.

5. The in-situ stress measurement method based on indentation technology and machine learning as claimed in claim 1, wherein in the step 4, during conducting the shallow indentation test, a ratio of an indentation depth h to an average scale L of microstructures of the rock core sample is greater than 5, and a ratio of the indentation depth h to a side length b of a cross-section of the rock core sample is less than 0.2.

6. The in-situ stress measurement method based on indentation technology and machine learning as claimed in claim 1, wherein the step 5 specifically comprises:

setting the minimum horizontal principal stresses as:

$\rho g h_r$, $1.2\rho g h_r$, $1.6\rho g h_r$, $2\rho g h_r$, $2.4\rho g h_r$ setting the maximum horizontal stresses as:

$0.8\rho g h_r$, $1.44\rho g h_r$, $2.56\rho g h_r$, $4\rho g h_r$, $5.76\rho g h_r$ where ρ represents a density of rock, g represents a gravitational acceleration, and $h_r$ represents a thickness of the overlying rock layer.

* * * * *